US011118738B1

(12) United States Patent
Che et al.

(10) Patent No.: US 11,118,738 B1
(45) Date of Patent: Sep. 14, 2021

(54) LIGHTING APPARATUS

(71) Applicant: XIAMEN LEEDARSON LIGHTING CO., LTD, Fujian (CN)

(72) Inventors: Juncheng Che, Fujian (CN); Yanzeng Gao, Fujian (CN); Wenchang Huang, Fujian (CN)

(73) Assignee: XIAMEN LEEDARSON LIGHTING CO., LTD, Xiamen (CN)

( * ) Notice: Subject to any disclaimer, the term of this patent is extended or adjusted under 35 U.S.C. 154(b) by 0 days.

(21) Appl. No.: 17/113,490

(22) Filed: Dec. 7, 2020

(30) Foreign Application Priority Data

May 29, 2020 (CN) ..... 202020957711.9

(51) Int. Cl.

| | |
|---|---|
| ***F21V 19/00*** | (2006.01) |
| ***F21K 9/237*** | (2016.01) |
| ***F21K 9/232*** | (2016.01) |
| *F21Y 115/10* | (2016.01) |

(52) U.S. Cl.
CPC ..... *F21K 9/237* (2016.08); *F21K 9/232* (2016.08); *F21V 19/0025* (2013.01); *F21Y 2115/10* (2016.08)

(58) Field of Classification Search
CPC ..... F21K 9/232; F21K 9/237; F21V 19/0025
See application file for complete search history.

(56) References Cited

U.S. PATENT DOCUMENTS

| | | | | |
|---|---|---|---|---|
| 10,697,591 | B1 * | 6/2020 | Yeutter | F21K 9/237 |
| 10,718,471 | B1 * | 7/2020 | Wu | F21K 9/66 |
| 10,731,798 | B2 * | 8/2020 | Jiang | F21K 9/232 |
| 2018/0080611 | A1 * | 3/2018 | Haberkorn | F21K 9/238 |

* cited by examiner

*Primary Examiner* — Karabi Guharay
(74) *Attorney, Agent, or Firm* — Chun-Ming Shih; Lanway IPR Services

(57) ABSTRACT

A light bulb apparatus includes a central column, a central bar, a top bracket, a bottom bracket, multiple elongated filaments and a bulb shell. The central column is made of glass material. The central column has a top part, a tubular part and a trumpet part. The top part and the trumpet part are located at two opposite ends of the tubular part. The central bar is extended from the central column upwardly. The top bracket has a limiting structure to limit a movement of the top bracket relative to the central bar. The bottom bracket is fixed to the central column. The multiple elongated filaments have bottom ends fixed to the bottom bracket and with top ends fixed to the top bracket. The bulb shell has a bottom edge fixed to the trumpet part forming a container space enclosing the bottom bracket and the multiple elongated filaments.

18 Claims, 20 Drawing Sheets

LIGHTING APPARATUS

FIELD

The present invention is related to a light bulb apparatus, and more particularly related to a light bulb apparatus with LED chips.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

Since Edison invents a commonly used light bulb, various light bulbs are used everywhere around the world. When LED technology emerges, the LED components are quickly used to replace the traditional light bulb devices.

However, the appearance of LED light bulbs is not attractive to some people. Elongated filaments mounted with LED chips are therefore produced. Such devices need to have a better design to provide a robust quality and low cost solution.

SUMMARY

In some embodiments, a light bulb apparatus includes a central column, a central bar, a top bracket, a bottom bracket, multiple elongated filaments and a bulb shell.

The central column is made of glass material.

The central column has a top part, a tubular part and a trumpet part.

The top part and the trumpet part are located at two opposite ends of the tubular part.

The central bar is extended from the central column upwardly.

The top bracket has a limiting structure to limit a movement of the top bracket relative to the central bar.

The bottom bracket is fixed to the central column.

The multiple elongated filaments have bottom ends fixed to the bottom bracket and with top ends fixed to the top bracket.

Each elongated filament has a substrate mounted with multiple LED chips covered by fluorescent layers.

The bulb shell has a bottom edge fixed to the trumpet part forming a container space enclosing the bottom bracket and the multiple elongated filaments.

In some embodiments, the limiting structure is an inner ring surrounding the central bar.

In some embodiments, the top bracket has an outer ring connected to the inner ring with an extension bar.

In some embodiments, the inner ring has a gap distance to the central bar.

In some embodiments, the inner ring is formed by bending an end of the extension bar.

In some embodiments, an elastic cap is attached to the central bar facing to the inner ring.

In some embodiments, the top bracket has multiple attaching grooves for connecting to top ends of the multiple elongated filaments.

In some embodiments, the bottom bracket has a first half bottom bracket and a second half bottom bracket.

The first half bottom bracket is made by bending a first metal strip partially embedded in the central column.

The second half bottom bracket is made of bending a second metal strip.

In some embodiments, the first metal strip and the second metal strips are nickel wires.

In some embodiments, the nickel wire has a width larger than 0.8 mm.

In some embodiments, the first metal strip and the second metal strip respectively have two sub-wires for connecting to positive and negative ends of a power source.

In some embodiments, multiple gap terminals are used for separating the two sub-wires and for electrically connecting the bottom ends of the elongated filaments to the two sub-wires.

In some embodiments, each elongated filament has two electrodes on the top end of the elongated filament.

The two electrodes are used for connecting to another elongated filament or to a power source.

In some embodiments, the top bracket has a conductive path for electrically connecting the electrodes of the multiple elongated filaments.

In some embodiments, the top bracket is fixed to the top ends of the multiple elongated filaments, then the top bracket is fixed to the central bar, and then the bottom ends of the multiple elongated filaments are fixed to the bottom bracket.

In some embodiments, the central bar is a tube for inserting a power wire electrically connecting to the multiple elongated filaments.

In some embodiments, the top bracket is made by stamping a metal plate.

The top bracket has an outer ring and an inner ring.

The outer ring is connected to the inner ring with an extension bar.

In some embodiments, the outer ring has multiple attaching pads.

The multiple attaching pads are made by bending multiple corresponding portions of the outer ring.

In some embodiments, the outer ring are connected to the inner ring with two opposite extension bars.

In some embodiments, the top bracket is made by bending a metal strip.

DETAILED DESCRIPTION

In some embodiments, a light bulb apparatus includes a central column, a central bar, a top bracket, a bottom bracket, multiple elongated filaments and a bulb shell.

The central column is made of glass material.

The central column has a top part, a tubular part and a trumpet part.

The top part and the trumpet part are located at two opposite ends of the tubular part.

The central bar is extended from the central column upwardly.

The top bracket has a limiting structure to limit a movement of the top bracket relative to the central bar. The movement of the top bracket may be limited to a range or completely non-moveable with respect to the central bar.

Figure 20:
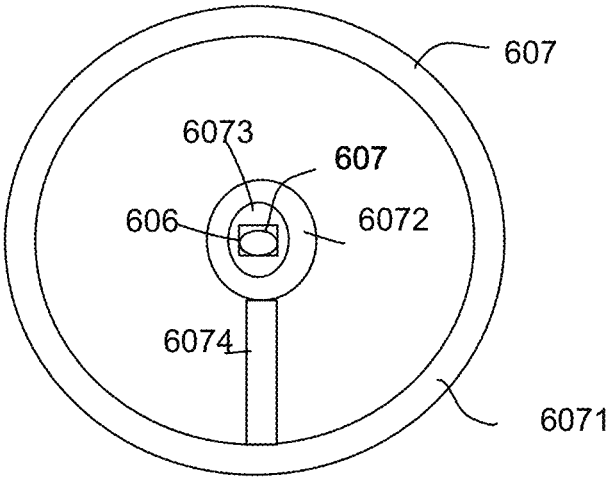
FIG. 20 illustrates a top bracket example.

In FIG. 20, an elastic cap 607 is attached to the central bar 606 facing to the inner ring 6072.

In some embodiments, the top bracket is made by stamping a metal plate.

The top bracket has an outer ring and an inner ring.

The outer ring is connected to the inner ring with an extension bar.

In some embodiments, the outer ring has multiple attaching pads.

The multiple attaching pads are made by bending multiple corresponding portions of the outer ring.

In some embodiments, the outer ring is connected to the inner ring with two opposite extension bars.

In some embodiments, the top bracket is made by bending a metal strip.

Figure 18:
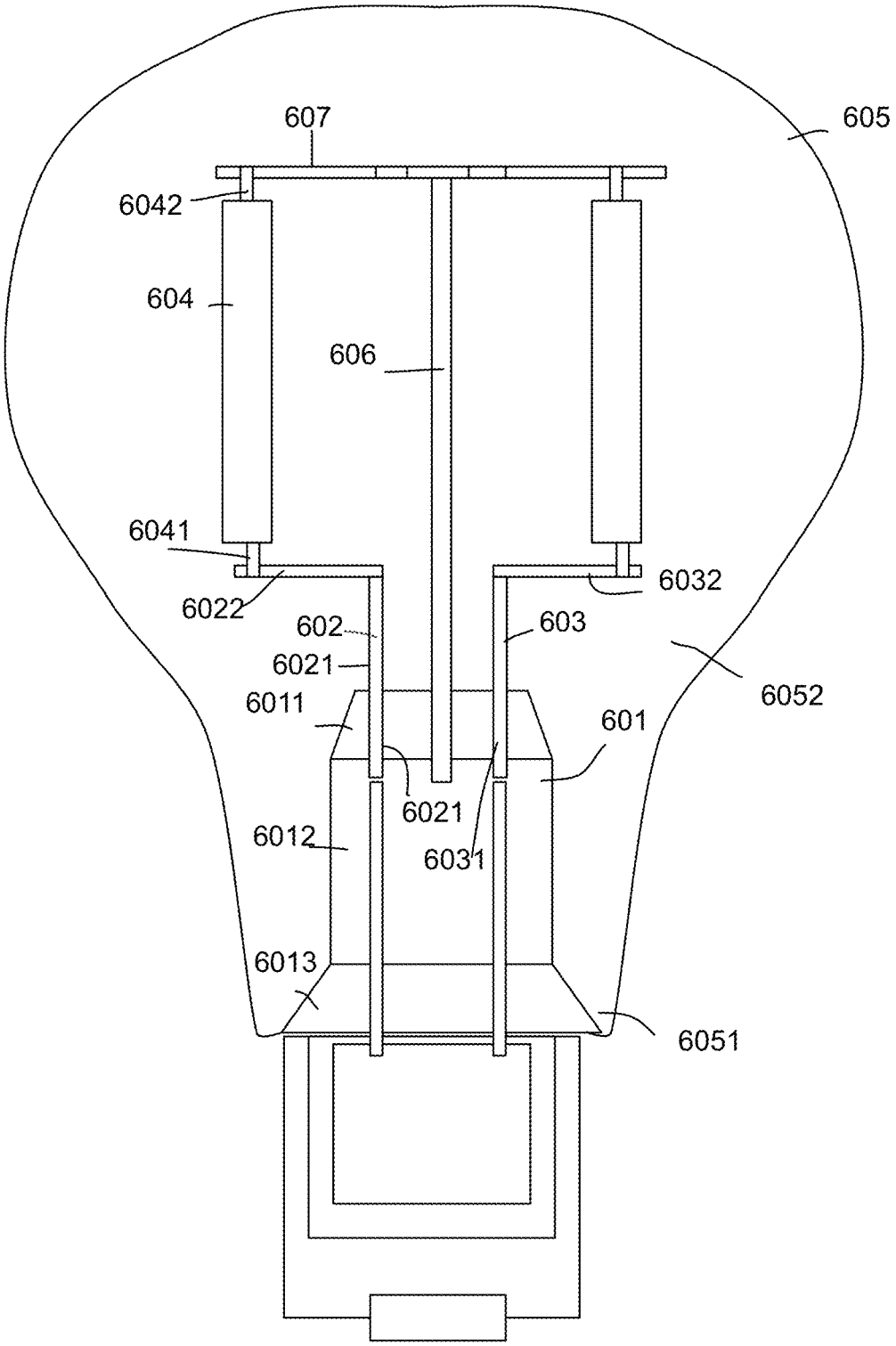
FIG. 18 illustrates another light bulb apparatus embodiment.

In FIG. 18, a light bulb apparatus includes a central column 601, a first metal strip 602, a second metal strip 603, multiple elongated filaments 604 and a bulb shell 605.

The central column 601 is made of glass material. Specifically, heated glass material may be pulled into a molding machine to form the shape of the central column 601.

The central column 601 has a top part 6011, a tubular part 6012 and a trumpet part 6013.

The top part 6011 and the trumpet part 6013 are located at two opposite ends of the tubular part 6012.

The first metal strip 602 has a first inner portion 6021 embedded in the top part 601 of the central column 601 and has a first bracket part exposed outside the top part 6011 of the central column 601 and bent as a first half bottom bracket 6022.

The second metal strip 603 has a second inner portion 6031 embedded in the top part 6011 of the central column 601 and has a second bracket part 6031 exposed outside the top part 6011 of the central column 601 and bent as a second half bottom bracket 6032.

The first half bottom bracket 6022 and the second half bottom bracket 6032 form a bottom bracket having a geometric ring.

Figure 19:
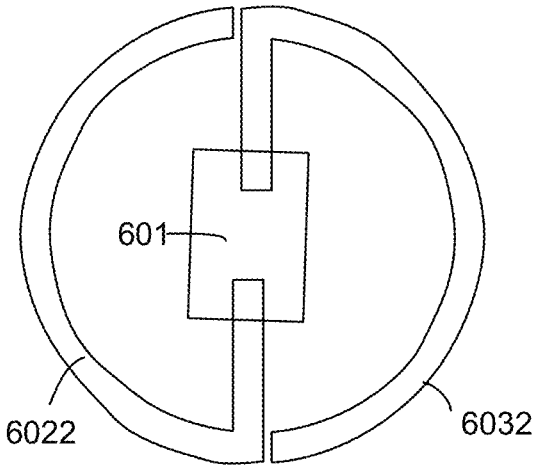
FIG. 19 illustrates a bottom bracket example.

FIG. 19 shows a top view of the first half bottom bracket 6022 and the second half bottom bracket 6032 above the central column 601. The first half bottom bracket 6022 and the second half bottom bracket 6032.

The multiple elongated filaments 604 have bottom ends 6041 fixed to the bottom bracket, i.e. either the first half bottom bracket 6022 or the second half bottom bracket 6032.

Figure 3:
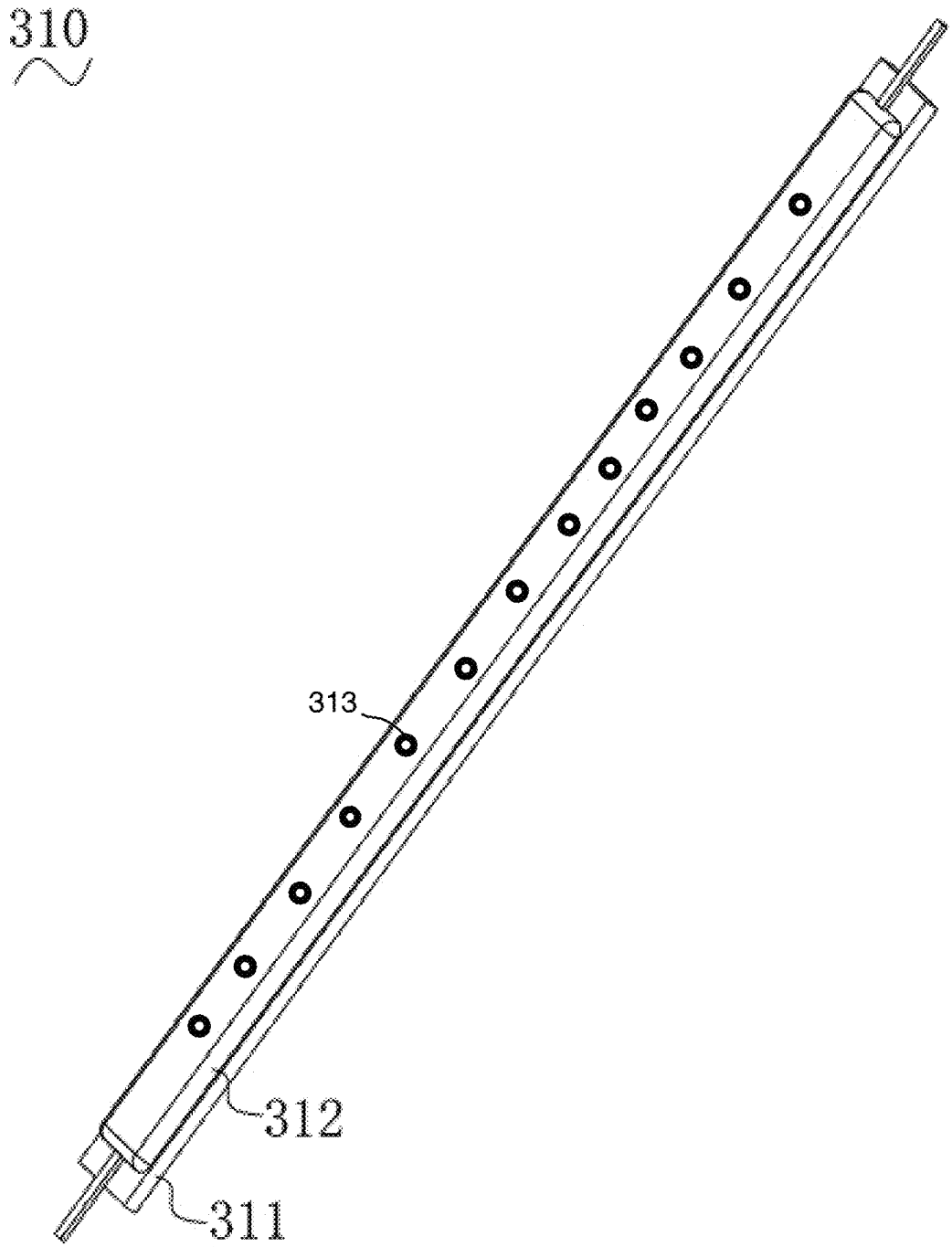
FIG. 3 illustrates an elongated filament example.

Please refer to FIG. 3, which shows an example of an elongated filament. Each elongated filament has a substrate 311 mounted with multiple LED chips 313 covered by a fluorescent layer 312.

In FIG. 18, the bulb shell 605 has a bottom edge 6051 fixed to the trumpet part 6013 forming a container space 6052 enclosing the bottom bracket, i.e. the first half bottom bracket 6022 and the second half bottom bracket 6032, and the multiple elongated filaments 604.

In some embodiments, the first metal strip and the second metal strips are nickel wires.

In some embodiments, the nickel wire has a width larger than 0.8 mm, e.g. 1 mm.

In some embodiments, there is central bar 606 extended from the central column 601 upwardly to limit a movement of a top bracket 607.

The top bracket 607 is used for fixing top ends 6042 of the multiple elongated filaments 604.

In some embodiments, the top bracket 607 has the same external shape as the geometrical ring, e.g. the bottom bracket of the first half bottom bracket 6022 and the second half bottom bracket 6023.

In some embodiments, the top bracket 607 has an inner ring 6072 and an outer ring 6071.

The top ends 6042 of the multiple elongated filaments 604 are fixed to the outer ring 6071.

The inner ring surrounds the central bar 606 to limit the movement of the top bracket 607.

In some embodiments, the inner ring 6071 has a gap distance 6073 to the central bar 606.

In some embodiments, the top bracket 607 has an extension bar 6074 from the outer ring 6071 to the inner ring 6072.

Figure 5:
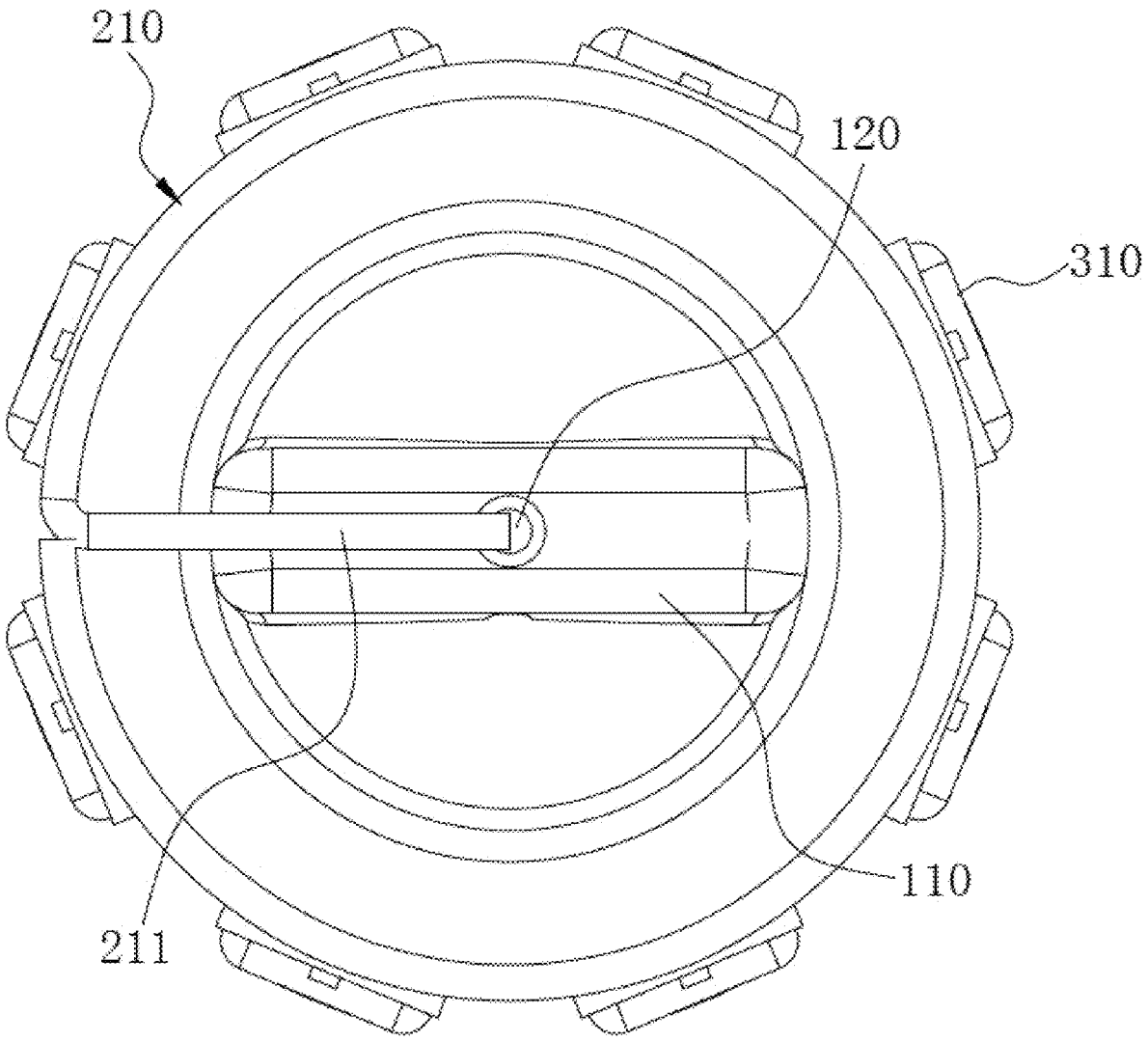
FIG. 5 illustrates a top view of the top bracket mounted with multiple elongated filaments.

In some embodiments, an end of the extension bar is bent to form the inner ring, as illustrated in the example of FIG. 5.

Figure 9:
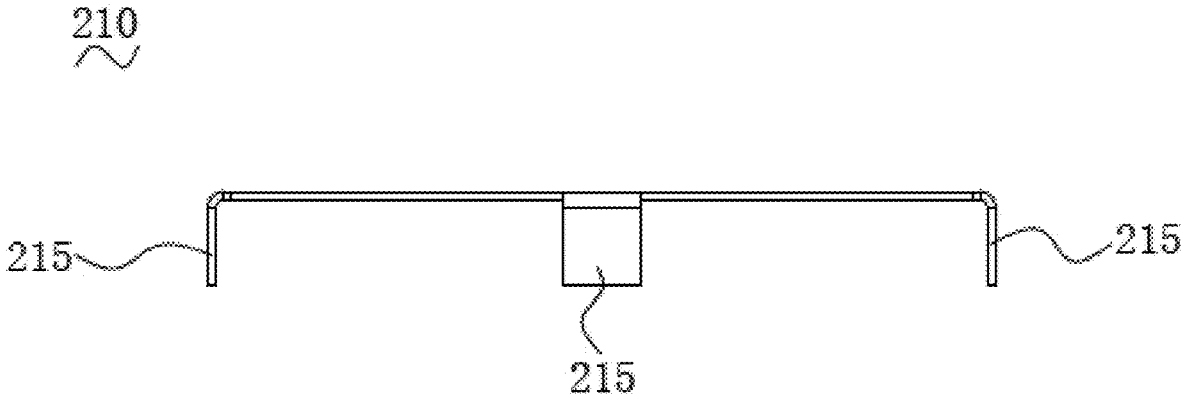
FIG. 9 illustrates another view of the example in FIG. 7.

In FIG. 9, the top bracket 200 has multiple attaching pads 230 for fixing the top ends of the multiple elongated filaments.

In some embodiments, the top bracket has multiple attaching grooves for fixing the top ends of the multiple elongated filaments. Such arrangement may be implemented by replacing the protruding bent attaching pads 230 in FIG. 9 with concave grooves.

In FIG. 18, the central bar 606 is partially embedded within the top part 6011 of the central column 601 between the first metal strip 602 and the second metal strip 603.

Figure 21:
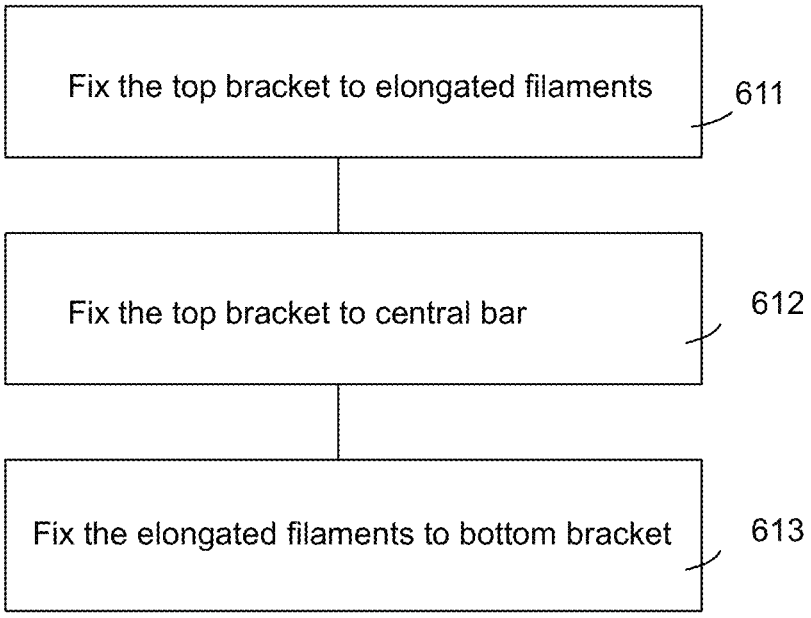
FIG. 21 illustrates a flowchart for assembling a light bulb apparatus.
Figure 22:
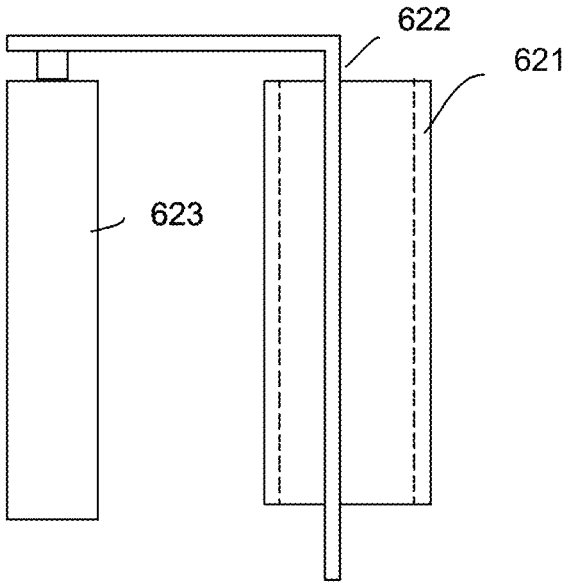
FIG. 22 illustrates a conductive path disposed inside a central bar.

In the flowchart of FIG. 21, the top bracket is fixed to the top ends of the multiple elongated filaments (step 611), then the top bracket is fixed to the central bar (step 612), and then the bottom ends of the multiple elongated filaments are fixed to the bottom bracket (step 613).

In some embodiments, the central bar 621 is a tube for inserting a power wire 622 electrically connecting to the multiple elongated filaments 623.

In some embodiments, the first half bottom bracket has a first semi-circle shape. The second half bottom bracket has a second semi-circle shape. The first semi-circle shape and the second semi-circle shape forms a circle shape, as illustrated in FIG. 19.

Figure 13:
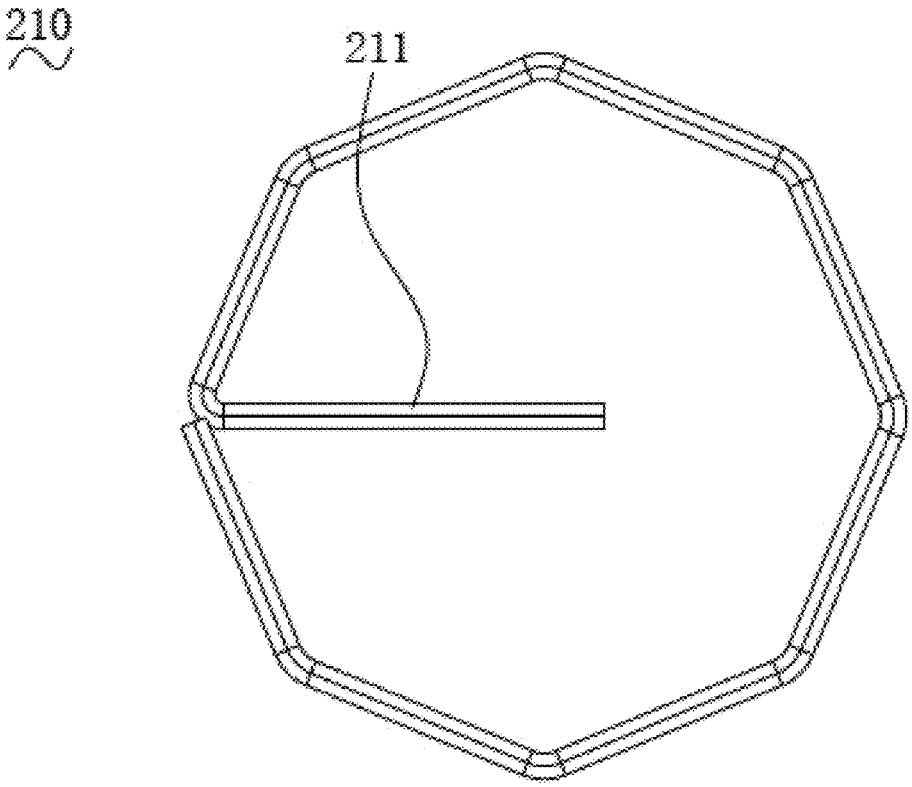
FIG. 13 illustrates another top bracket example.

In some embodiments, the first half bottom bracket and the second half bottom bracket form a polygonal shape, as the example in FIG. 13, which shows a polygonal shape.

Figure 23:
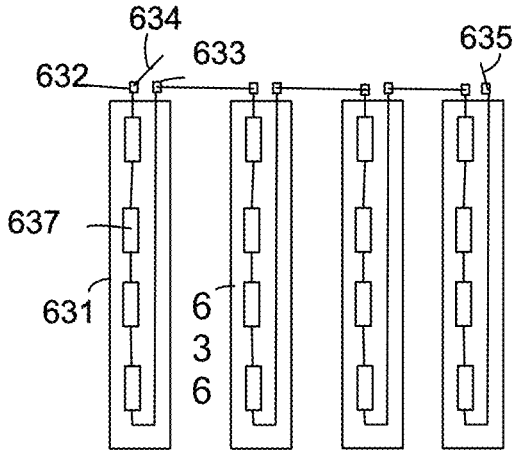
FIG. 23 shows a first connection among elongated filaments.

In FIG. 23, each elongated filament 631 has two electrodes 632, 633 on the top end of the elongated filament 631.

The two electrodes 632, 633 are used for connecting to another elongated filament 636 or to a power source. For example, four elongated filaments respectively have two electrodes on one side. The LED modules 637 in the elongated filaments are connected in series while providing two electrodes 632, 633 for connecting to positive and negative ends of power supply. The electrodes 632, 633 among the elongated filaments are connected in series to adjacent elongated filaments or to power wires 634, 635.

With such arrangement, the multiple elongated filaments may be electrically connected only on the top side, e.g. with conductive paths disposed on the top bracket or with wires connecting the multiple elongated filaments. The top bracket may further route the electricity connection via the central bar to a driver enclosed in a cap below the central column.

In such design, all electrical connection is performed on the top side. The bottom bracket is only used for supporting the elongated filaments, without providing electricity connection. For example, the electrical path is completed via the conductive path disposed on the top bracket and via an inner tunnel or surface of the central bar. Specifically, two conductive paths may be disposed on the central bar, both on surface or one on surface and one on inner side of the central bar.

Figure 24:
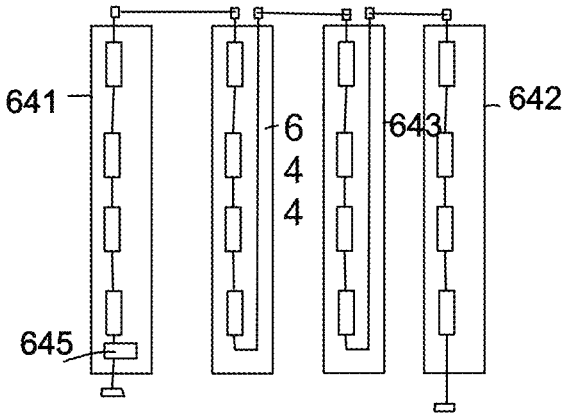
FIG. 24 shows a second connection among elongated filaments.

FIG. 24 shows another design. In FIG. 24, a first type of elongated filament 641, 642 are used for connecting to power wires disposed on the bottom part, e.g. via the first half bottom bracket and the second half bottom bracket for the positive and the negative ends of the electrical power source. Electrical connections among the first type of elongated filaments 641, 642 and the second type of elongated filaments 643, 644 are performed on top side of the light bulb apparatus, e.g. on the top bracket.

In addition, the first type of elongated filament 641 may have an electronic component 645, like a resistor, a capacitor, a fuse, a filter, a driver component to integrate with the multiple elongated filaments to provide a modular design.

In some embodiments, an antenna, e.g. at the position of the electronic component 645, may be disposed on the elongated filament. Such antenna is not covered by any metal shielding and may provide better signal quality when the antenna is electrically connected to a driver that needs to send or receive a wireless signal from an external device.

In some embodiments, the top bracket has a conductive path for electrically connecting the electrodes of the multiple elongated filaments.

In some embodiments, the first metal strip and the second metal strip respectively have two sub-wires for connecting to positive and negative ends of a power source.

In some embodiments, the first metal strip and the second metal strip are used for connecting to a positive end of the power source while the central bar and the top bracket are used for connecting to a negative end of the power source. Alternatively, the first metal strip and the second metal strip are used for connecting to a negative end of the power source while the central bar and the top bracket are used for connecting to a positive end of the power source.

Figure 25:
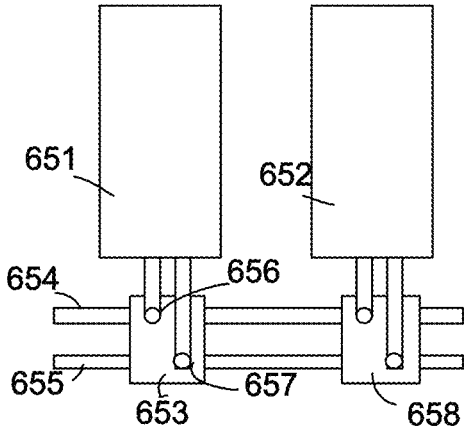
FIG. 25 shows gap terminals used in a first metal strip connecting elongated filaments.

In FIG. 25, multiple gap terminals 653, 658 are used for separating the two sub-wires 654, 655 of the first metal strip and for electrically connecting two electrodes 656, 657 of the bottom ends of the elongated filaments 651, 652 to the two sub-wires 654, 655. With such design, the first wire has two sub-wires 654, 655 for providing a positive end and a negative end of a power supply. The gap terminals 653, 658 keeps the two sub-wires 654, 655 uncontacted. In addition, the gap terminals 653, 658 provide sockets for inserting the electrodes 656, 657 of the elongated filament 651 for performing electrical connection to the elongated filaments. It is the same to the second metal strip and is not repeated again.

The gap terminals 653, 654 may be made of plastic material embedded with conductive paths to perform the connection mentioned above.

Figure 1:
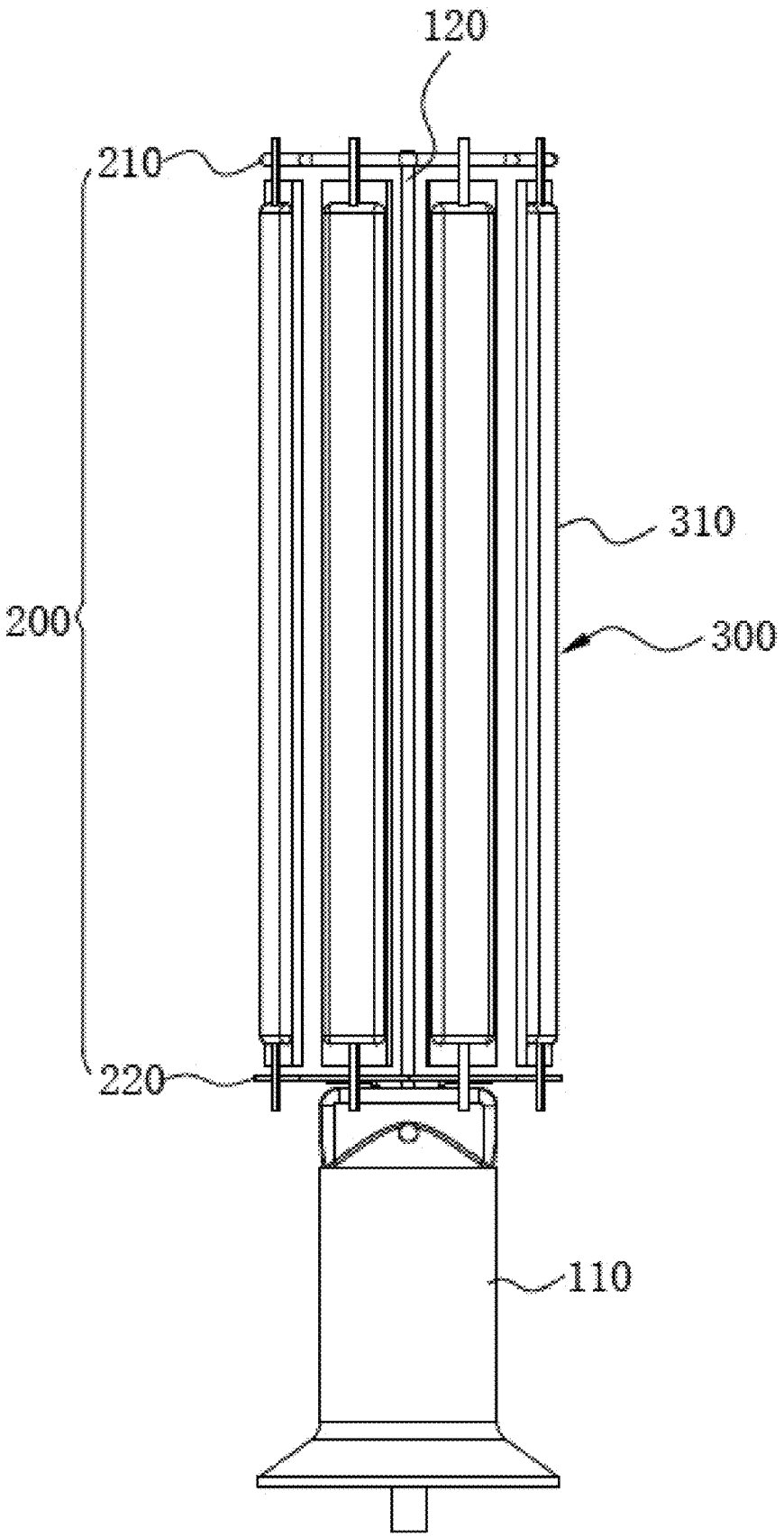
FIG. 1 illustrates a module used in a light bulb apparatus embodiment.

Please refer to FIG. 1. In FIG. 1, multiple elongated filaments 310 have top ends connected to a top bracket 200 and multiple bottom ends connected to a bottom bracket 130. The bottom bracket 130 is disposed on a central column 110. There is also a central bar 120 extended from the central column 110 to limit a movement of the top bracket 200. These components in FIG. 1 are assembled as a light source module 300 to be further fixed to a bulb shell and a cap to produce a light bulb apparatus.

Figure 2:
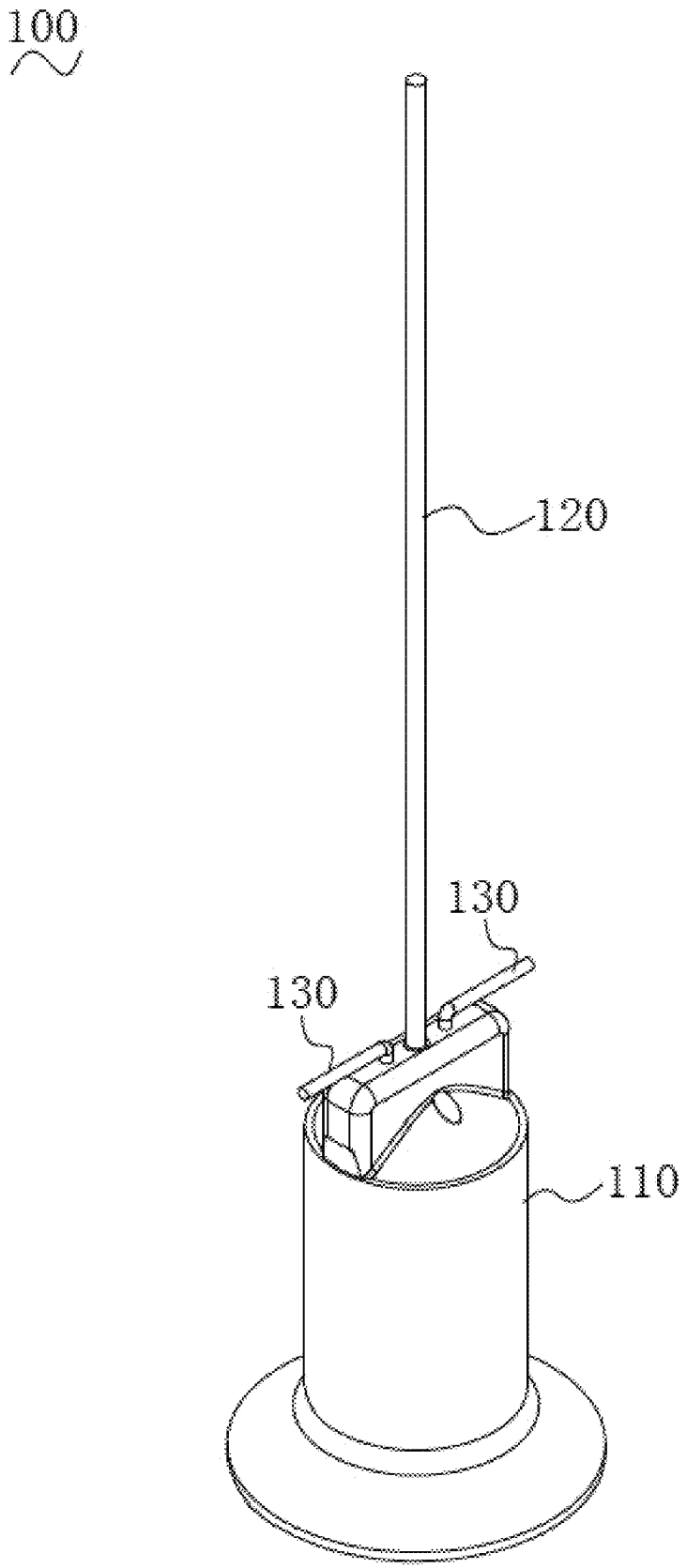
FIG. 2 illustrates a component that is under processing.

Please refer to FIG. 2. In FIG. 2, a central column 110 are embedded with a first metal strip and a second metal strip 131. The first metal strip and the second metal strip 131 form a bottom bracket 130. The central bar 120 is also partially embedded in the central column 110 while exposing a protruding part extended upwardly from the central column 110.

FIG. 3 shows an example of an elongated filament and has been explained above.

Figure 4:
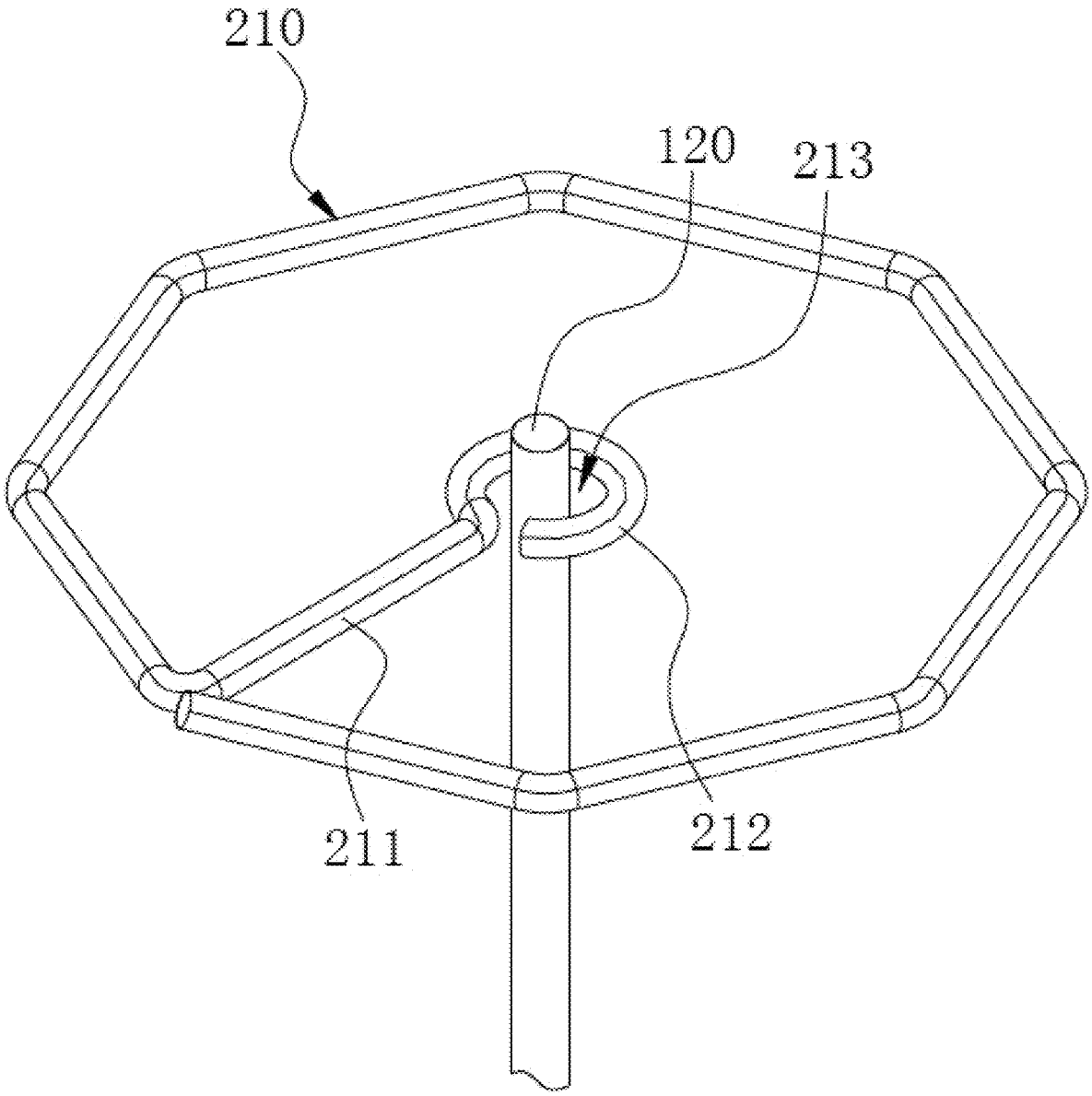
FIG. 4 illustrates a top bracket and a central bar.

FIG. 4 illustrates a top bracket 210. The top bracket 210 has an extension bar 211 for connecting an outer ring to an inner ring 212 as the limiting structure. The inner ring 212 has a gap distance to the central bar 120.

Please refer to FIG. 5. In FIG. 5, multiple elongated filaments 310 are fixed to the to the top bracket 200. The relation among the central column 110, the central bar 120 and the extension bar 210 are illustrated, too.

Figure 6:
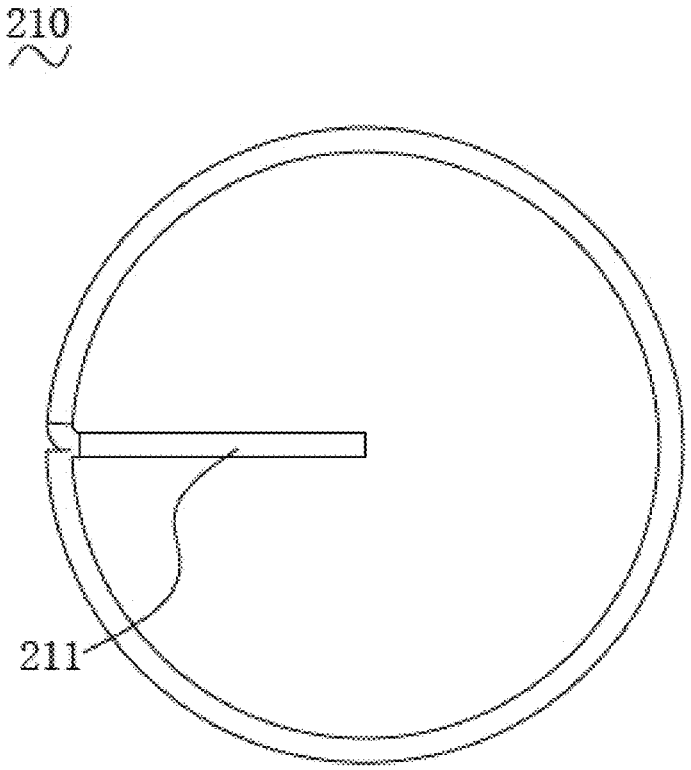
FIG. 6 illustrates a top bracket example.

Please refer to FIG. 6. FIG. 6 shows another embodiment of an extension bar 210 of a top bracket. In this example, there is no inner circle as the limiting structure. The end of the extension bar 210 may be fixed to the central bar directly to limit movement of the top bracket.

Figure 7:
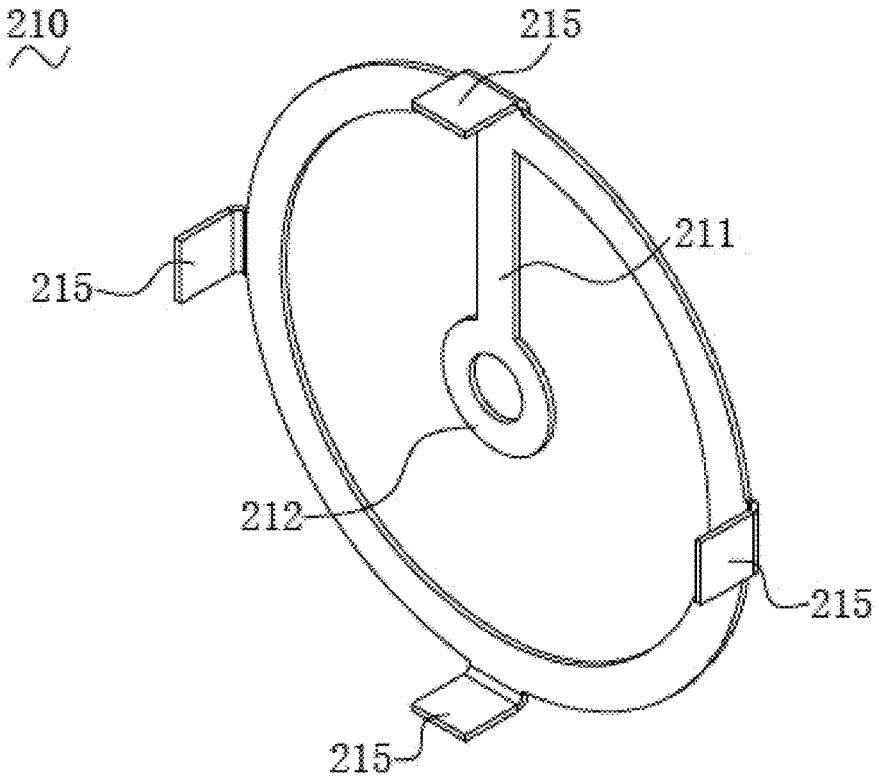
FIG. 7 illustrates another top bracket example.

Please refer to FIG. 7. In FIG. 7, multiple attaching pads 230 are disposed on an outer ring of a top bracket 200. There is an inner ring 211 as the limiting structure connected by an extension bar 210.

Figure 8:
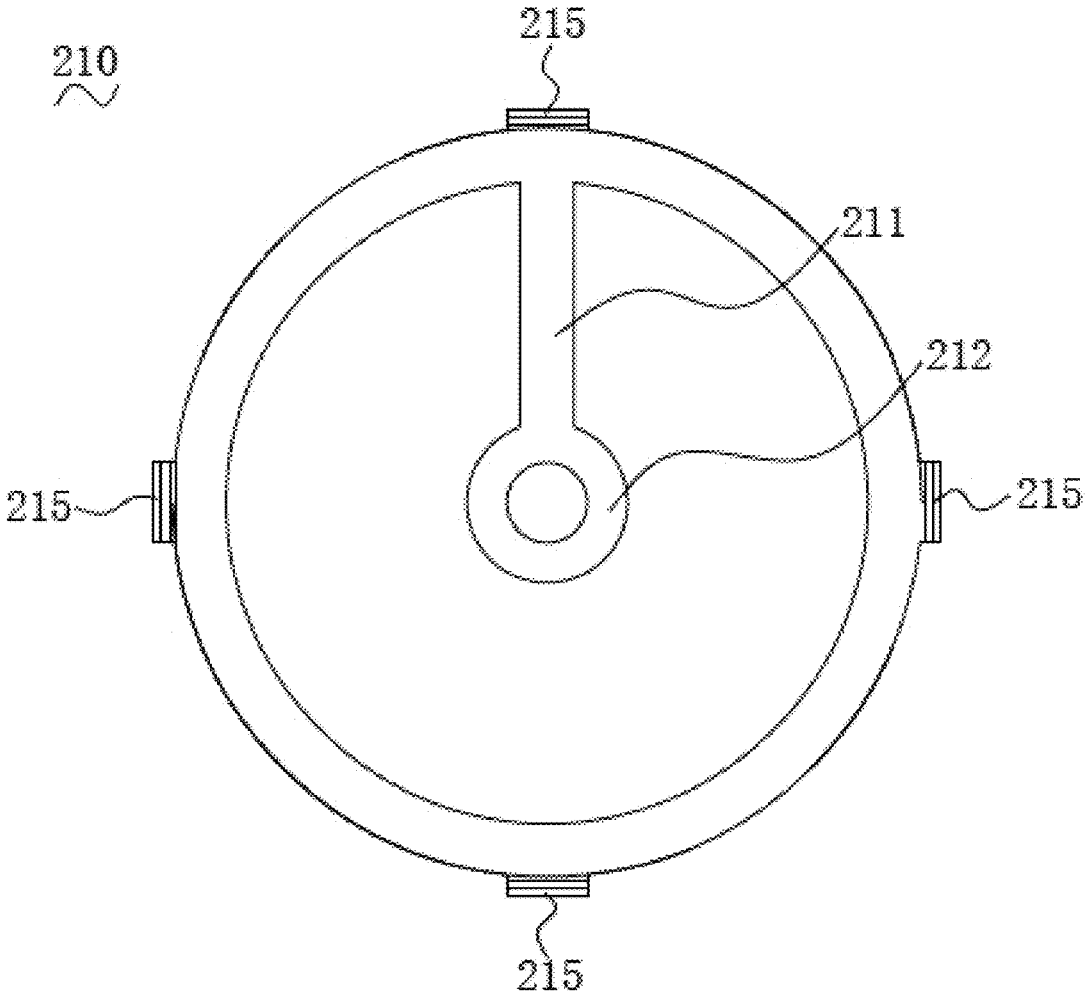
FIG. 8 illustrates another view of the example in FIG. 7.

Please refer to FIG. 8. FIG. 8 shows another view of the example of FIG. 7.

Please refer to FIG. 9. FIG. 9 shows a side view of the example in FIG. 7.

Figure 10:
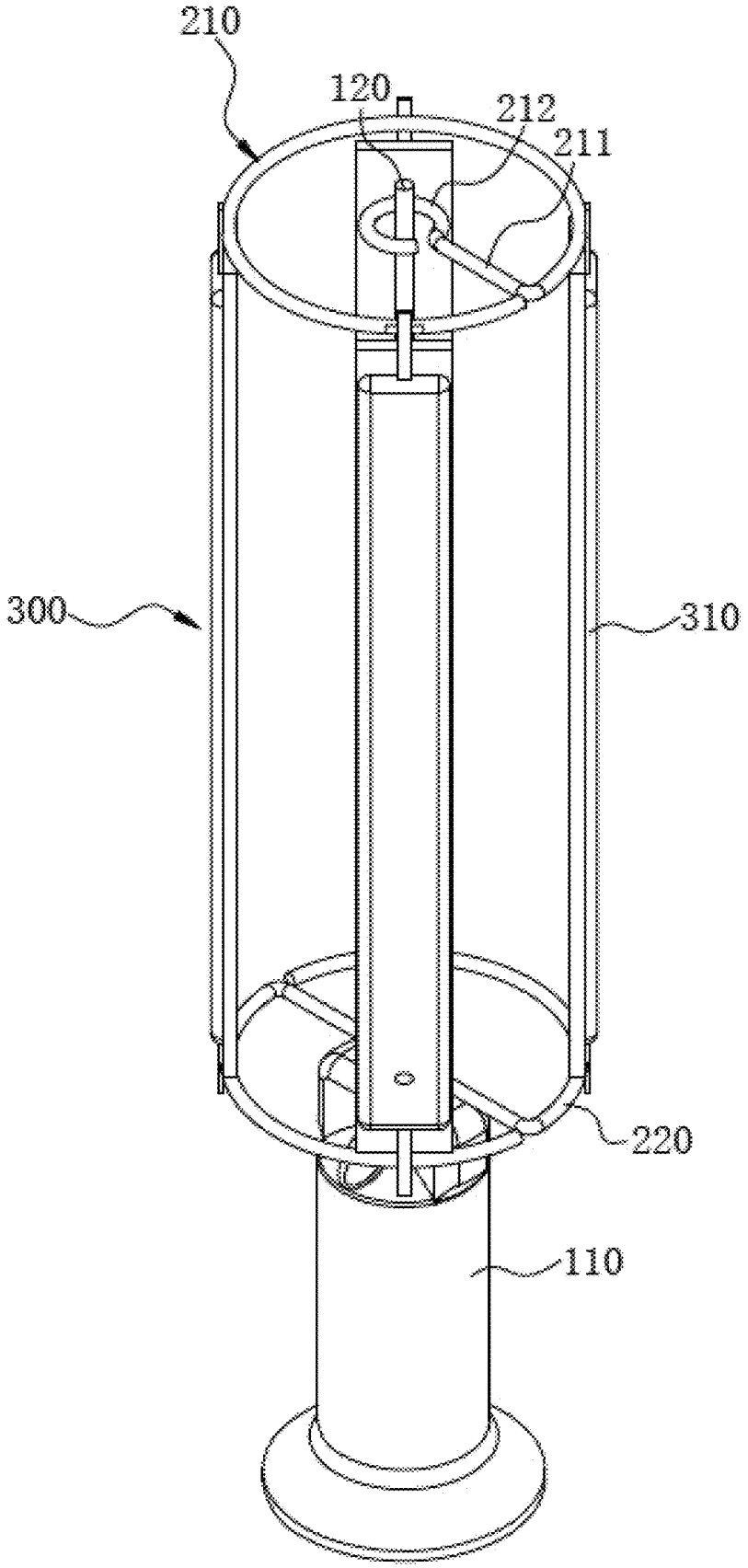
FIG. 10 illustrates a component to be installed in a light bulb apparatus.

Please refer to FIG. 10. In FIG. 10, a top bracket 200 is formed by bending a metal strip with an outer ring and an inner ring 211 as a limiting structure. An extension bar 210 is connecting the outer ring to the inner ring 211. The inner ring 211 does not contact the central bar 120, but limits the movement of the top bracket 200 with respect to the central bar 120 within a range.

The light source module 300 has multiple elongated filaments 310 with bottom ends connected to a bottom bracket 130 that is fixed on a central column 110.

Figure 11:
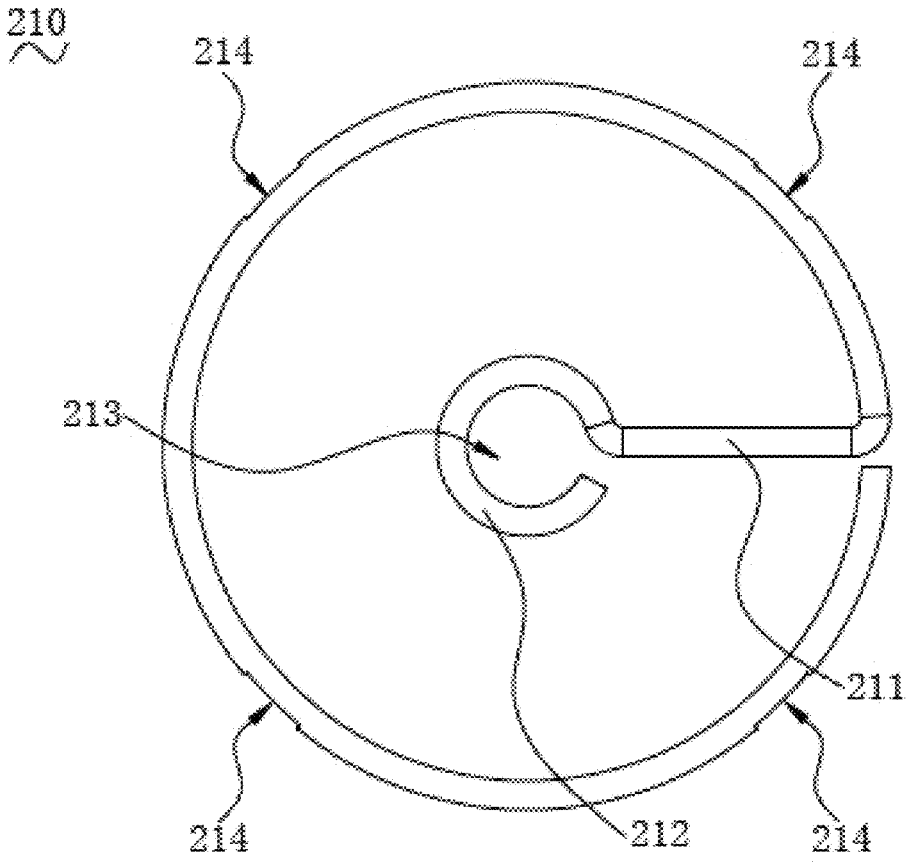
FIG. 11 illustrates another top bracket example.

Please refer to FIG. 11. In FIG. 11, a top bracket 200 has an outer ring disposed with multiple attaching grooves 220 for fixing top ends of the elongated filaments. There is an inner ring 211 as the limiting structure having a limiting hole 212.

Figure 12:
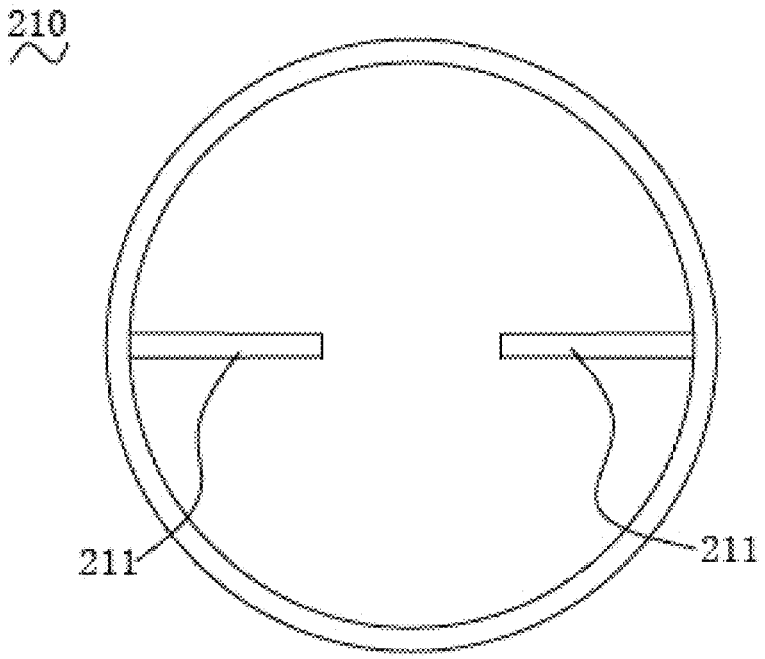
FIG. 12 illustrates another top bracket example.

Please refer to FIG. 12. FIG. 12 shows another embodiment of the top bracket 200, in which there are two extension bars 210 to be more reliable.

Please refer to FIG. 13. FIG. 13 shows another embodiment of a top bracket 200. The top bracket 200, unlike previous examples, has a polygonal shape. In addition, conductive paths with insulation may be disposed on the top bracket for electrically connecting the multiple elongated filaments.

Figure 14:
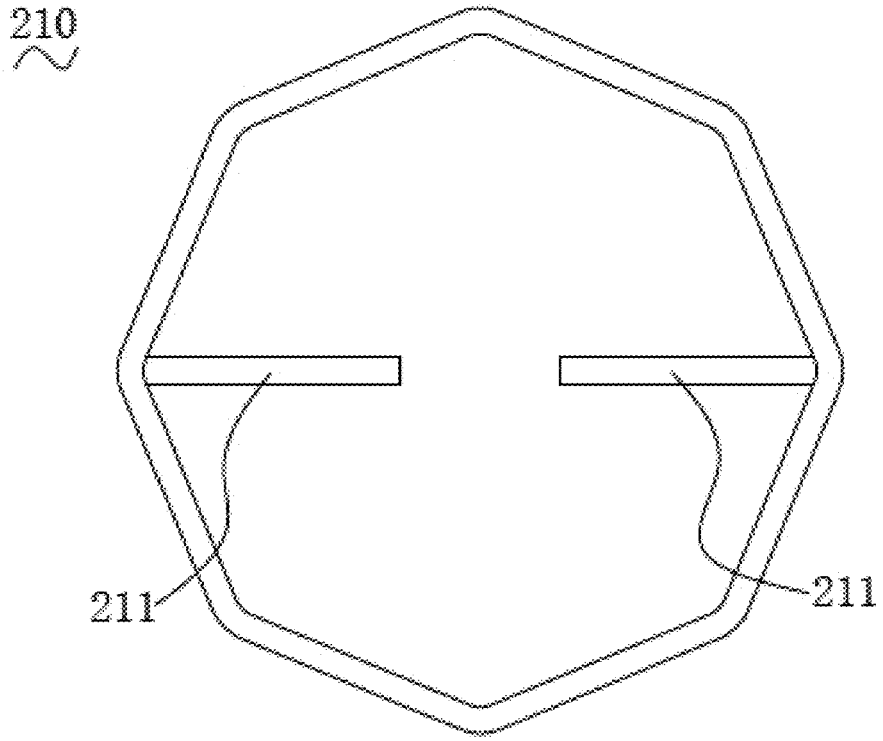
FIG. 14 illustrates another top bracket example.

Please refer to FIG. 14. FIG. 14 shows another embodiment of a top bracket 200. Two extension bars 210 are formed in a polygonal shape top bracket.

Figure 15:
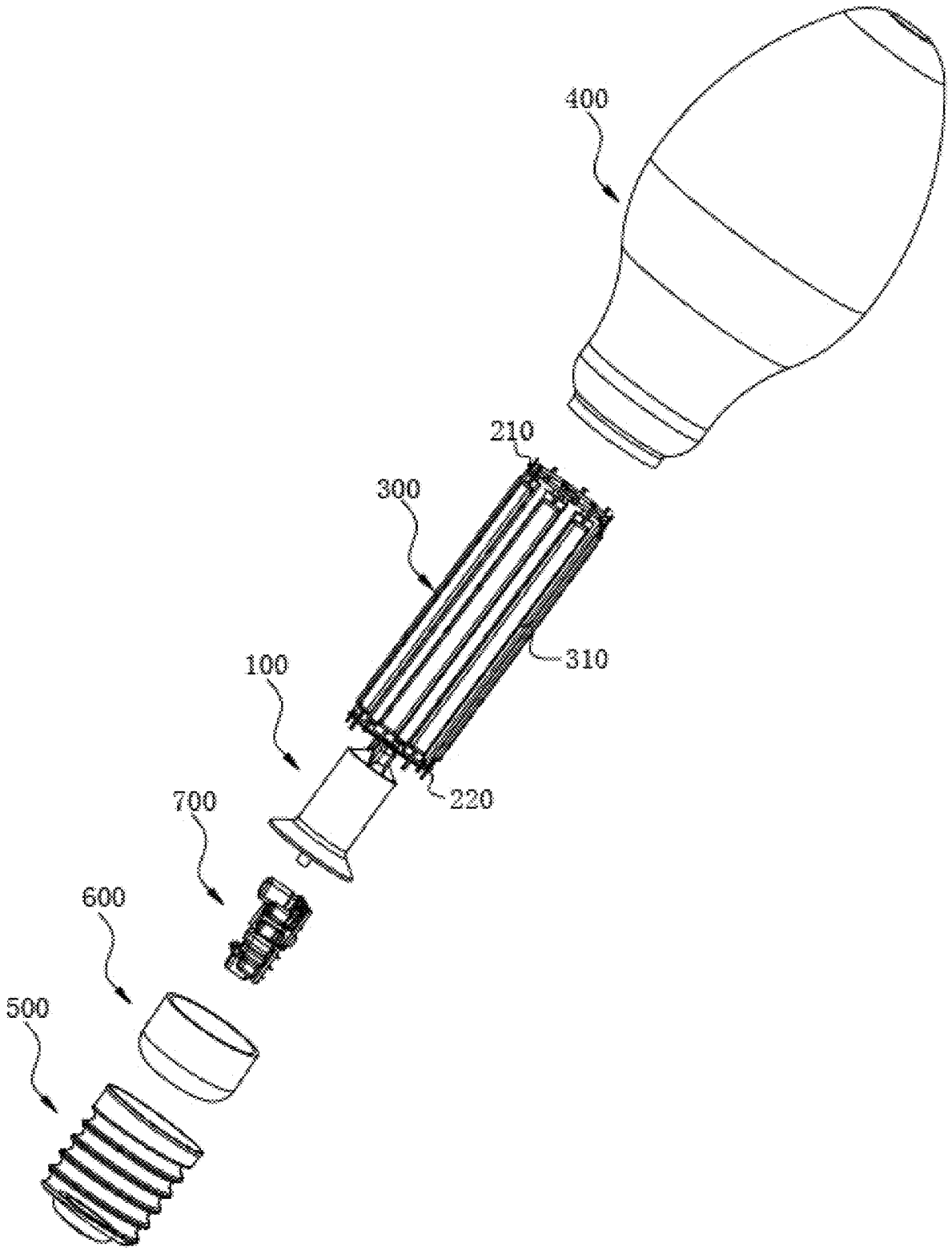
FIG. 15 illustrates an exploded view of a light bulb example.

Please refer to FIG. 15. FIG. 15 shows an exploded view of a light bulb apparatus.

In FIG. 15, a bulb shell 400 is fixed to a central column 100 forming a container space enclosing the light source module 300 that includes multiple elongated filaments 310 with two ends fixed to the top bracket 200 and the bottom bracket 130. There is a driver 700 for converting an external power received from an Edison cap 500 to driving currents supplied to the multiple elongated filaments 310. There is an insulation cup 600 for isolating the driver 700 to prevent electrical shock.

Figure 16:
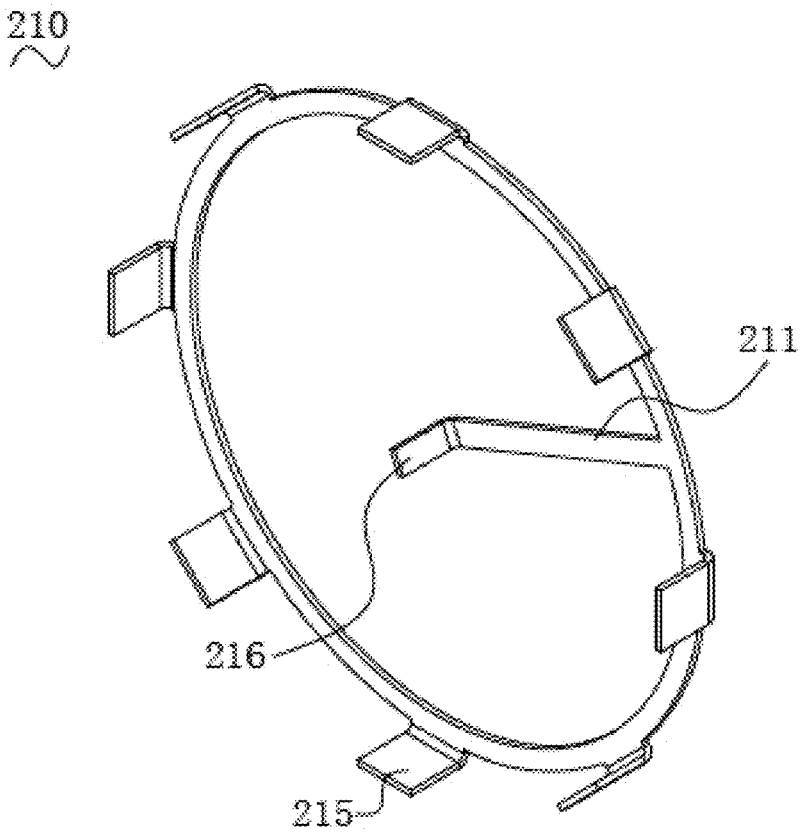
FIG. 16 illustrates another top bracket example.

Please refer to FIG. 16. FIG. 16 shows a top bracket 200 example with attaching pads 230. In this example, there is no inner ring but a bent pad 240 for fixing to the central bar.

Figure 17:
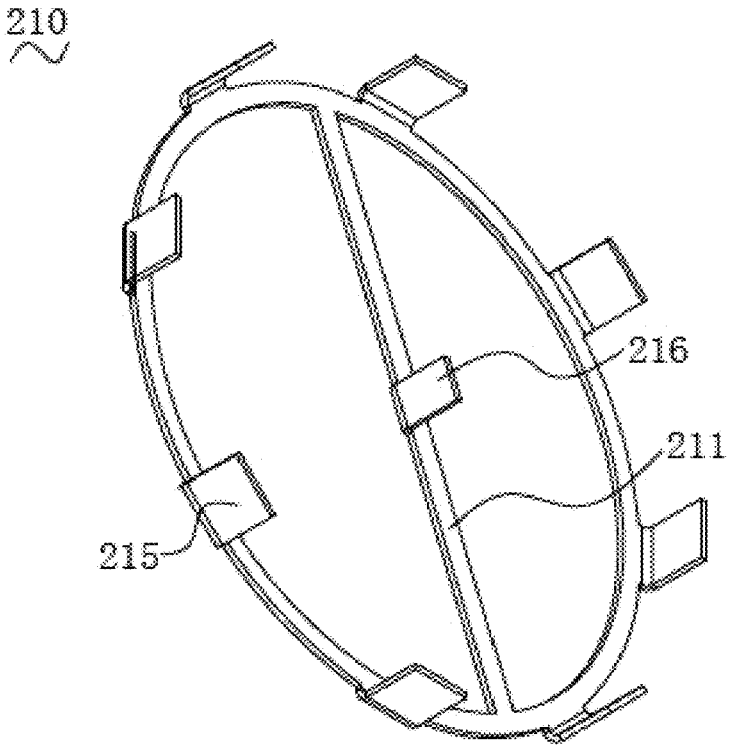
FIG. 17 illustrates another top bracket example.

Please refer to FIG. 17, which shows another view of the example in FIG. 16.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A light bulb apparatus, comprising: a central column, wherein the central column is made of glass material, the central column has a top part, a tubular part and a trumpet part, the top part and the trumpet part are located at two opposite ends of the tubular part; a central bar extended from the central column upwardly; a top bracket having a limiting structure to limit a movement of the top bracket relative to the central bar; a bottom bracket fixed to the central column; multiple elongated filaments with bottom ends fixed to the bottom bracket and with top ends fixed to the top bracket, wherein each elongated filament has a substrate mounted with multiple LED chips covered by fluorescent layers; and a bulb shell with a bottom edge fixed to the trumpet part forming a container space enclosing the bottom bracket and the multiple elongated filaments, wherein the top bracket is made by stamping a metal plate, the top bracket has an outer ring and an inner ring, the outer ring is connected to the inner ring with an extension bar, the outer ring has multiple attaching pads for respectively attaching the multiple elongated filaments, the multiple attaching pads are made by bending multiple corresponding portions of the outer ring.

2. The light bulb apparatus of claim 1, wherein the limiting structure is an inner ring surrounding the central bar.

3. The light bulb apparatus of claim 1, wherein the top bracket has an outer ring connected to the inner ring with an extension bar.

4. The light bulb apparatus of claim 3, wherein the inner ring has a gap distance to the central bar.

5. The light bulb apparatus of claim 3, wherein the inner ring is formed by bending an end of the extension bar.

6. The light bulb apparatus of claim 5, wherein an elastic cap is attached to the central bar facing to the inner ring.

7. The light bulb apparatus of claim 1, wherein the top bracket has multiple attaching grooves for connecting to top ends of the multiple elongated filaments.

8. The light bulb apparatus of claim 1, wherein the bottom bracket has a first half bottom bracket and a second half bottom bracket, the first half bottom bracket is made by bending a first metal strip partially embedded in the central column, the second half bottom bracket is made of bending a second metal strip.

9. The light bulb apparatus of claim 8, wherein the first metal strip and the second metal strips are nickel wires.

10. The light bulb apparatus of claim 9, wherein the nickel wire has a width larger than 0.8 mm.

11. The light bulb apparatus of claim 8, wherein the first metal strip and the second metal strip respectively have two sub-wires for connecting to positive and negative ends of a power source.

12. The light bulb apparatus of claim 11, wherein multiple gap terminals are used for separating the two sub-wires and for electrically connecting the bottom ends of the elongated filaments to the two sub-wires.

13. The light bulb apparatus of claim 1, wherein each elongated filament has two electrodes on the top end of the elongated filament, the two electrodes are used for connecting to another elongated filament or to a power source.

14. The light bulb apparatus of claim 13, wherein the top bracket has a conductive path for electrically connecting the electrodes of the multiple elongated filaments.

15. The light bulb apparatus of claim 13, wherein the top bracket is fixed to the top ends of the multiple elongated filaments, then the top bracket is fixed to the central bar, and then the bottom ends of the multiple elongated filaments are fixed to the bottom bracket.

16. The light bulb apparatus of claim 15, wherein the central bar is a tube for inserting a power wire electrically connecting to the multiple elongated filaments.

17. The light bulb apparatus of claim 1, wherein the outer ring are connected to the inner ring with two opposite extension bars.

18. The light bulb apparatus of claim 1, wherein the top bracket is made by bending a metal strip.

* * * * *